US008185009B2

(12) United States Patent
Song

(10) Patent No.: US 8,185,009 B2
(45) Date of Patent: May 22, 2012

(54) IMAGE FORMING APPARATUS AND METHOD OF CONTROLLING A FUSING UNIT THEREOF

(75) Inventor: Hyun-soo Song, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 414 days.

(21) Appl. No.: 12/473,419

(22) Filed: May 28, 2009

(65) Prior Publication Data

US 2010/0028037 A1 Feb. 4, 2010

(30) Foreign Application Priority Data

Aug. 1, 2008 (KR) ..... 10-2008-0075753

(51) Int. Cl.
*G03G 15/20* (2006.01)

(52) U.S. Cl. ..... 399/70; 399/67; 399/69

(58) Field of Classification Search ..... 399/67, 399/69, 70, 88

See application file for complete search history.

(56) References Cited

U.S. PATENT DOCUMENTS

| | | | | |
|---|---|---|---|---|
| 5,966,562 | A * | 10/1999 | Maehara | 399/69 |
| 6,853,818 | B2 * | 2/2005 | Nishida | 399/67 |
| 7,321,738 | B2 * | 1/2008 | Kaji et al. | 399/69 |
| 7,324,773 | B2 * | 1/2008 | Sugiyama | 399/88 |
| 2007/0183805 | A1 * | 8/2007 | Tsukada | 399/69 |

FOREIGN PATENT DOCUMENTS

| | | |
|---|---|---|
| KR | 20030030962 | 4/2003 |
| KR | 20050029516 | 3/2005 |
| KR | 20070099140 | 10/2007 |

* cited by examiner

*Primary Examiner* — Sandra Brase
(74) *Attorney, Agent, or Firm* — Stanzione & Kim, LLP

(57) ABSTRACT

An image forming apparatus and a method of controlling a fusing unit thereof are provided. The method includes: detecting a present mode of the image forming apparatus; selecting a waveform number control to control an electric power source which is supplied to the fusing unit when the present mode is a standby mode; and supplying the electric power source to one of a plurality of heat generating members depending on the waveform number control to prevent the plurality of heat generating members from being simultaneously supplied with the electric power.

22 Claims, 12 Drawing Sheets

IMAGE FORMING APPARATUS AND METHOD OF CONTROLLING A FUSING UNIT THEREOF

CROSS-REFERENCE TO RELATED APPLICATIONS

This application claims priority from Korean Patent Application No. 10-2008-0075753, filed on Aug. 1, 2008 in the Korean Intellectual Property Office, the disclosure of which is incorporated herein by reference.

BACKGROUND OF THE INVENTION

1. Field of the Invention

The present general inventive concept relates to an image forming apparatus and a method of controlling a fusing unit thereof, and more particularly, to an image forming apparatus improving noises in a standby mode and a method of controlling of a fusing unit thereof.

2. Description of the Related Art

An image forming apparatus includes an image forming unit to develop a visible image corresponding to a wanted image on a printing medium with a toner, and a fusing unit to fuse the toner on the printing medium with heat and pressure. The printing medium passes through the image forming unit and the fusing unit, and then is discharged, thereby completing printing on the printing medium. An electronic copier, a laser printer, a multifunction, etc. belong to the image forming apparatus.

Here, the fusing unit includes a heating roller to accommodate a heat generating member. The heat generating member receives an alternating current power to generate a heat. A pressing roller is included to press the printing medium toward the heating roller. The image forming apparatus includes a power supplying unit to supply the alternating current power to the heat generating member.

To maintain the temperature of the fusing unit within a predetermined objective temperature range, the alternating current power is controlled by two control types, a waveform number control and a phase control.

As illustrated in FIG. 1, the phase control may control the alternating current power by chopping a half wavelength of the alternating current power with respect to a phase thereof and supplying the alternating current power to the heat generating member. As illustrated in FIG. 1, by supplying the alternating current power corresponding to chopped sections A1, A2, A3 and A4 to the heat generating member, the amount of heat generated by the heat generating member is controlled. Here, the sections A1 to A4 represent chopping the half wavelength of the alternating current power by 33%, 50%, 75% and 100% respectively. Here, if the alternating current power supplied to the heat generating member approaches that of an impulse or harmonics near a natural frequency of an element configuring the power supplying unit as the chopped section gets narrower, excessive noise may be caused by resonance.

As illustrated in FIG. 2, the waveform number control may control the number of the waveform of the half wavelength of the alternating current power supplied to the heat generating member, and adopts a waveform of the half wavelength of the alternating current power as a basic unit of a control.

For example, when all of the waveform of the half wavelength alternating current power is supplied, there is a 100% waveform number control. For example, when three waveforms B among four waveforms C are supplied, there is a 75% waveform number control. For example, when a single waveform E among three waveforms D is supplied, there is a 33% waveform number control. For example, when a single waveform G of two waveforms F is supplied, there is a 50% waveform number control. By determining waveforms to be supplied among n waveforms, as exemplified above, the waveform number control is available.

However, in the waveform number control, a large amount of current flows when a power supply starts. This can be referred to as an inrush current The inrush current increases when the fusing unit is designed to generate more heat, such as when there are a plurality of heat generating members. This excessive inrush current causes an excessive voltage variation, and accordingly, a flicker phenomenon may be caused, which is known as the turning on and off of a lamp. The flicker phenomenon may cause a malfunction of the fusing unit, and may even damage a circuit in the power supplying unit.

SUMMARY OF THE INVENTION

The present general inventive concept provides an image forming apparatus and a control unit of a fusing unit of the image forming apparatus, reducing a flicker phenomenon by a waveform number control and concurrently reducing noises caused by a phase control.

Additional aspects and utilities of the present general inventive concept will be set forth in part in the description which follows and, in part, will be obvious from the description, or may be learned by practice of the general inventive concept.

The present general inventive concept can also provide an image forming apparatus and a method of controlling a fusing unit of the image forming apparatus, efficiently controlling the fusing unit depending on a present mode of the image forming apparatus.

Embodiments of the present general inventive concept can be achieved by providing a method of controlling a fusing unit of an image forming apparatus including detecting a present mode of the image forming apparatus, selecting a waveform number control to control an electric power which is supplied to the fusing unit when the present mode is a standby mode, and supplying the electric power to one of a plurality of heat generating members depending on the waveform number control to prevent the plurality of heat generating members from being simultaneously supplied with electric power.

The method may further include controlling the electric power depending on at least one of a phase control and the waveform number control when the present mode is a printing mode.

The controlling the electric power source may include controlling the electric power depending on the phase control when a temperature of the fusing unit is lower than or equal to a predetermined value, and controlling the electric power depending on the waveform number control after performing the phase control.

The method may further include controlling the electric power depending on a phase control or the waveform number control when the present mode is a warming up mode.

The controlling the electric power may include converting the plurality of heat generating members from an off state to an on state one after another during a time interval.

When a waveform number control is ended for the electric power source to be supplied to the one of the heat generating members, then a waveform number control is started for the electric power to be supplied to the remaining heat generating member.

The selecting the waveform number control may include selecting the waveform number control of a different percent (%), based on a sensed temperature of the fusing unit.

The method may further include controlling the electric power based on a temperature of a central portion of the fusing unit for one of the plurality of heat generating members, and a temperature of an end portion of the fusing unit for another thereof.

The method may further include displaying, in a display unit, a control type of the electric power depending on the mode in a display unit of the image forming apparatus.

Embodiments of the present general inventive concept can also be achieved by providing an image forming apparatus, including a fusing unit which includes a plurality of heat generating members to fuse a developer on a printing medium, a power supplying unit which supplies an electric power to the fusing unit, and a control unit which controls the power supplying unit to control the electric power for the fusing unit depending on a waveform number control, and to apply the electric power to one of the heat generating members to prevent the electric power from being simultaneously supplied to the plurality of heat generating members when a present mode is a standby mode.

The control unit may control the electric power depending on at least one of a phase control and the waveform number control when the present mode is a printing mode.

The control unit may control the electric power depending on the phase control when a temperature of the fusing unit is lower than or equal to a predetermined value, and then controls the electric power depending on the waveform number control.

The control unit may control the electric power depending on a phase control or the waveform number control when the present mode is a warming up mode.

The plurality of heat generating members may be converted from an off state to an on state one after another during a time interval.

The control unit may start a waveform number control for the electric power to be supplied to the remaining heat generating member when a waveform number control is ended for the electric power which is to be applied to the one of the heat generating members.

The control unit may control the electric power by applying the waveform number control of a different percent (%), based on a sensed temperature of the fusing unit.

The control unit may control the electric power based on a temperature of a central portion of the fusing unit for one of the plurality of heat generating members, and a temperature of an end portion of the fusing unit for another thereof.

The image forming apparatus may further include a display unit, wherein the display unit may display a control type of the electric power depending on the mode of the image forming apparatus.

Embodiments of the present general inventive concept can also be achieved by providing an image forming apparatus, including a fusing unit which includes a plurality of heat generating members to fuse a developer on a printing medium, a power supplying unit which supplies an electric power to the plurality of heat generating members, and a control unit which controls the electric power which is to be supplied to the plurality of heat generating members depending on a plurality of modes according to a present state of the image forming apparatus.

Embodiments of the present general inventive concept can also be achieved by providing a method of controlling a fusing unit of an image forming apparatus including detecting a present mode of the image forming apparatus, selecting one of controls based on the present mode, controlling an electric power based on the selected control, and supplying the electric power to one of a plurality of heat generating members.

The present mode may be detected to be a stand by mode and the selected control may include a waveform number control.

The waveform number control may be ended for the electrical power to be applied to the one of the heat generating members, and then a waveform number control may be started for the electric power to be applied to the remaining heat generating member.

The selecting of a control may include selecting a waveform number control of a different percent (%), based on a sensed temperature of the fusing unit.

BRIEF DESCRIPTION OF THE DRAWINGS

The present general inventive concept will become apparent and more readily appreciated from the following description of the exemplary embodiments, taken in conjunction with the accompanying drawings, of which.

DETAILED DESCRIPTION OF THE PREFERRED EMBODIMENTS

Figure 1:
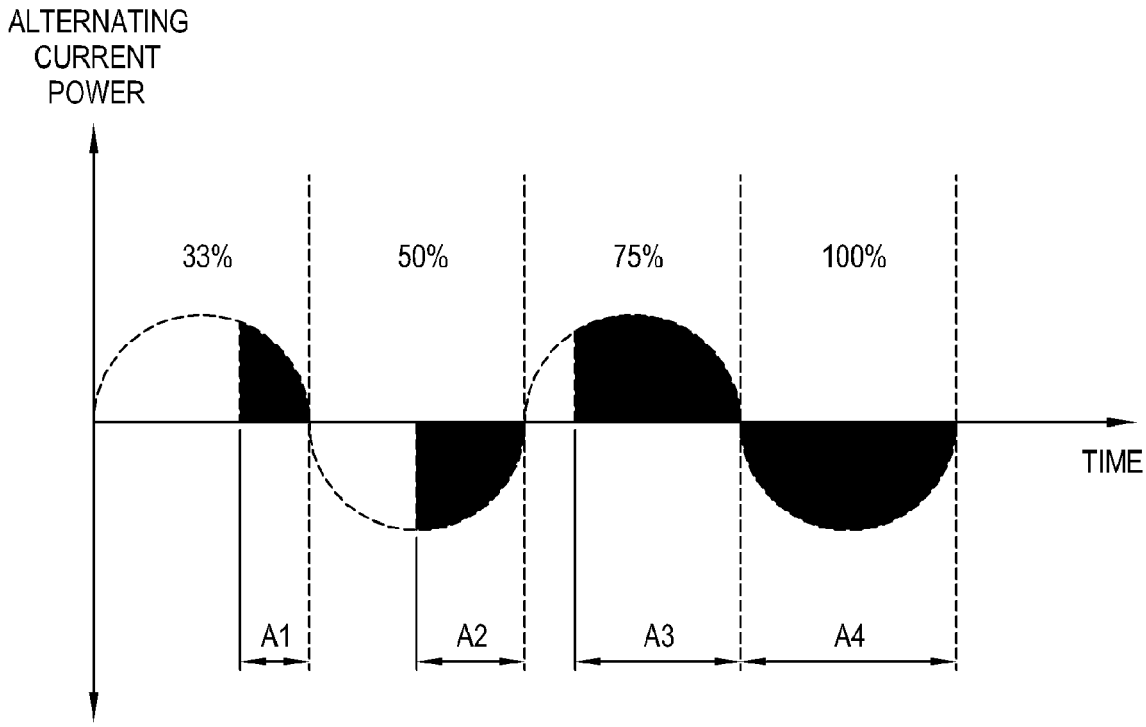
FIGS. 1 and 2 are drawings that illustrate a phase control and a waveform number control respectively.
Figure 2:
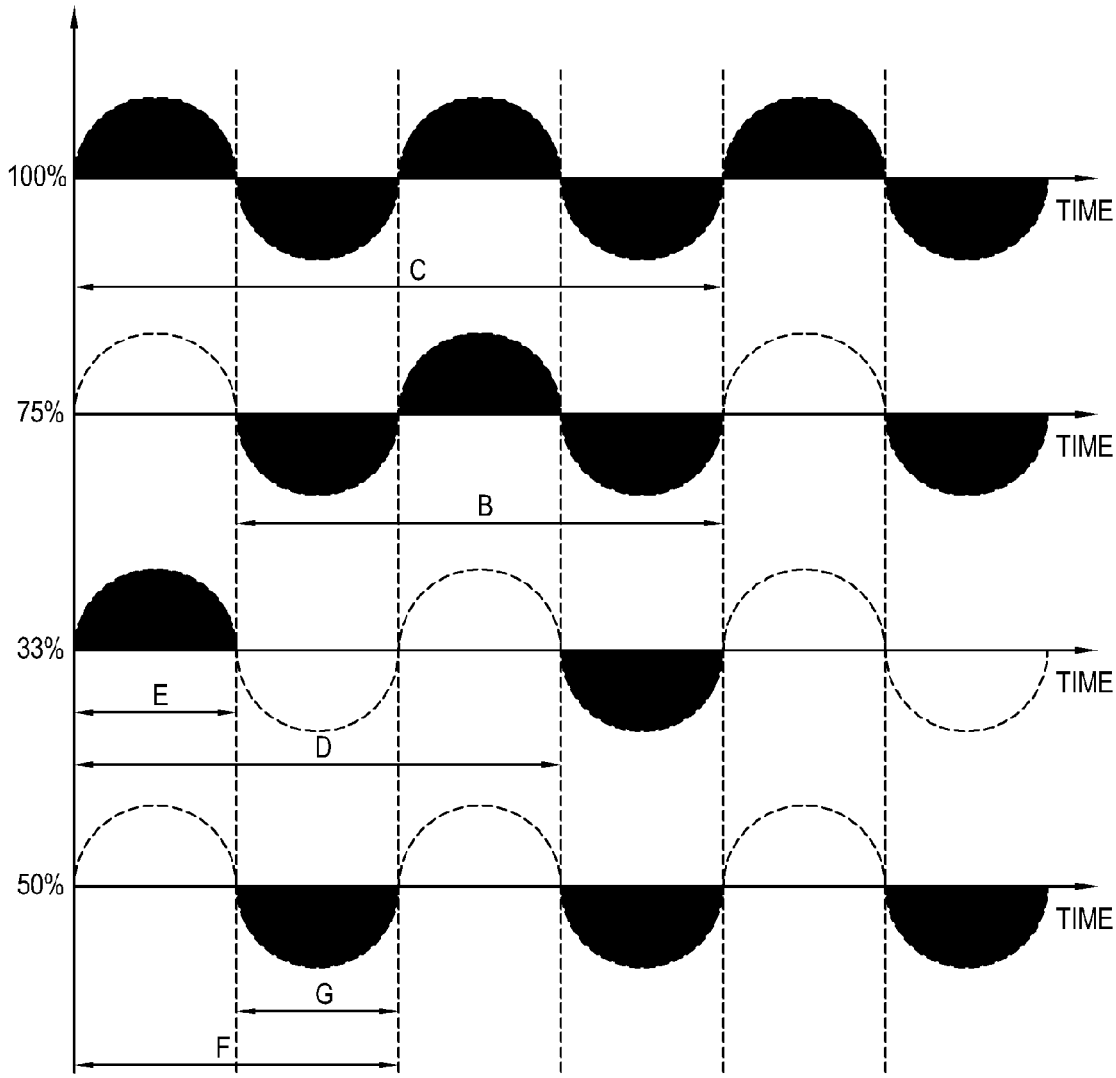

Reference will now be made in detail to exemplary embodiments of the present general inventive concept, examples of which are illustrated in the accompanying drawings, wherein like reference numerals refer to like elements throughout. The exemplary embodiments are described below so as to explain the present general inventive concept by referring to the figures. Repetitive description with respect to like elements of different embodiments may be omitted for the convenience of clarity.

Figure 3:
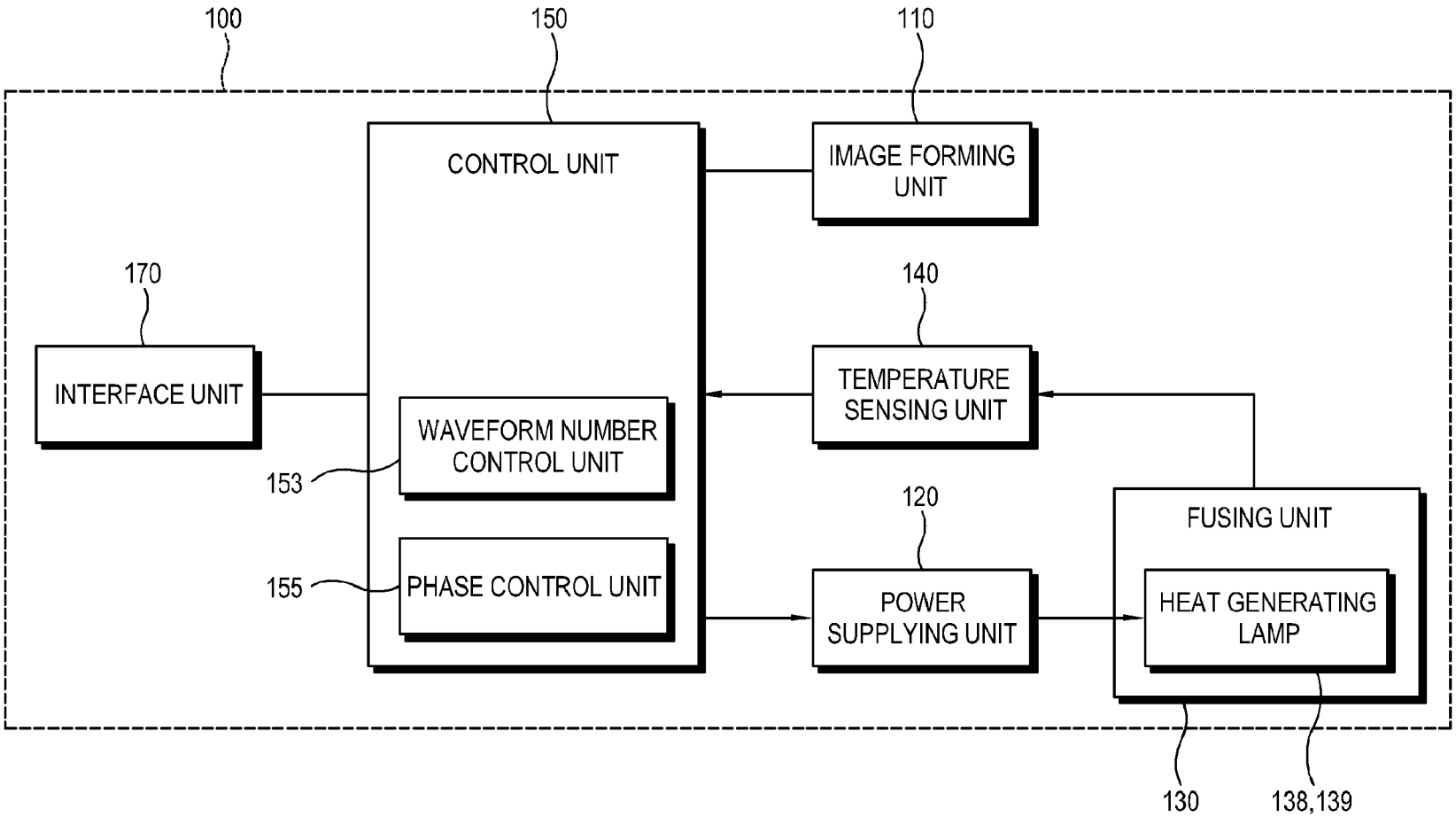
FIG. 3 is a block diagram of an image forming apparatus according to an exemplary embodiment of the present general inventive concept.
Figure 4:
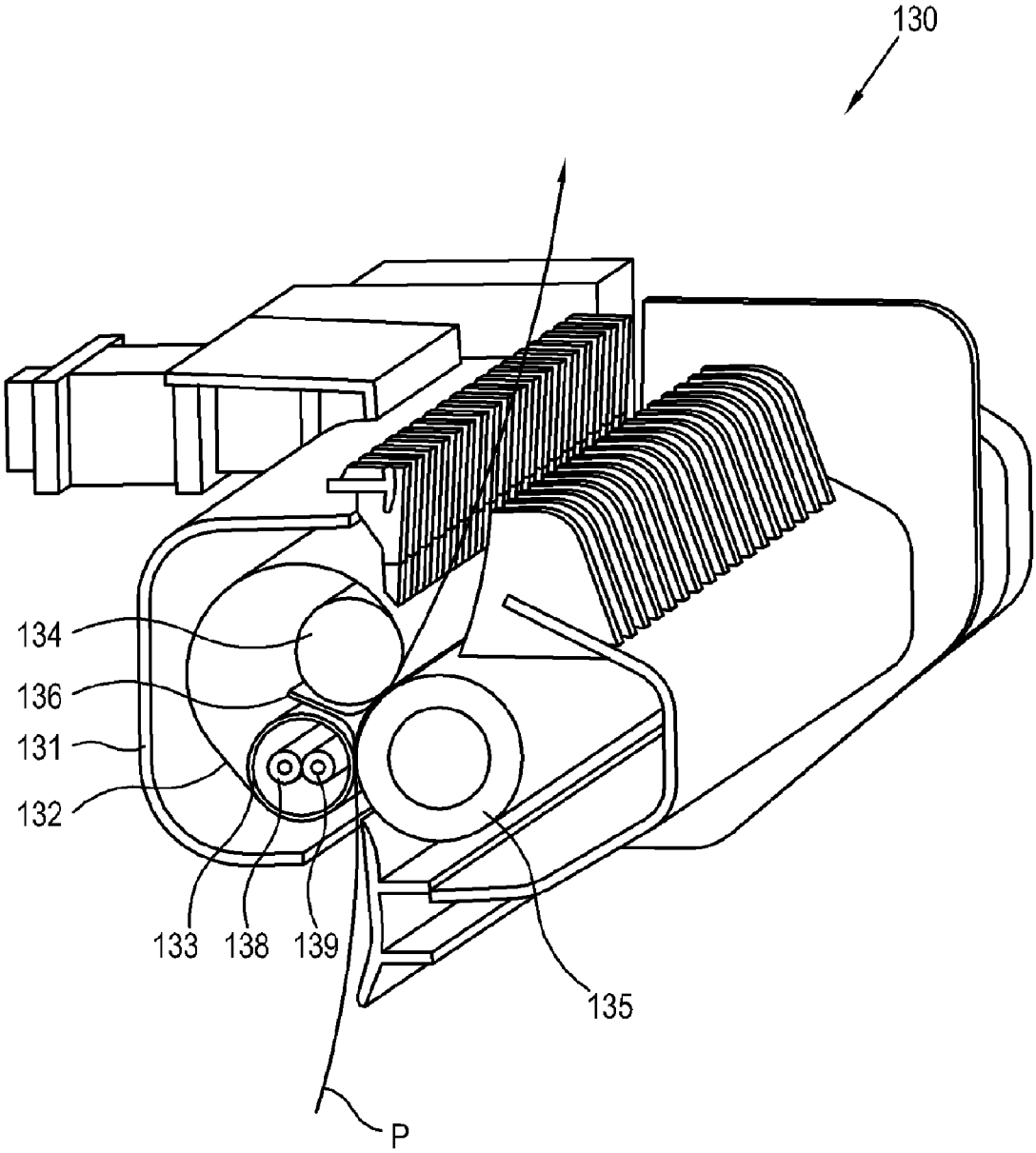
FIG. 4 is a schematic perspective view of a fusing unit of the image forming apparatus in FIG. 3.

As illustrated in FIGS. 3 and 4, an image forming apparatus 100 according to an exemplary embodiment of the present general inventive concept includes an image forming unit 110 to form a wanted visible image on a printing medium with a developer, a fusing unit 130 to fuse the developer on the printing medium with heat and pressure, a power supplying unit 120 to supply an alternating current power to a plurality of heat generating members 138 and 139 of the fusing unit 130, and a control unit 150 to control the power supplying unit 120.

As used herein, the term "developer" refers to any agent used in the process of developing an image. For example, a "developer" may include, but is not limited to, a toner.

The image forming unit 110 includes an image carrying body (not illustrated), a light exposing unit (not illustrated) to expose the image carrying body depending on a printing data received through an interface unit 170 to form an electrostatic latent image corresponding to a wanted image, a developing unit (not illustrated) to develop the electrostatic latent image with a developer to form a visible image on a surface of the image carrying body, and a transferring unit (not illustrated) to transfer the visible image on the surface of the image carrying body to a printing medium.

Here, the image carrying body may include, but is not limited to, a photosensitive drum. The light exposing unit may include, but is not limited to, a light scanning unit (LSU) scanning a laser light on a surface of the image carrying body.

As illustrated in FIG. 4, the fusing unit 130 includes a fusing belt 132, the plurality of heat generating members 138 and 139 to heat the fusing belt 132, a heating roller 133 to accommodate the plurality of heat generating members 138 and 139, and a pressing roller 135 to press a printing medium against the heating roller 133. Also, the fusing unit 130 may further include a fusing unit frame 131 to accommodate the fusing belt 132, the heating roller 133 and the pressing roller 135. The fusing unit frame 131 may further include upper and lower sides which are open to allow the printing medium to pass through along a transportation path P.

Here, while the printing medium is transported along the transportation path P, a developer on the printing medium is fused on the printing medium by heat from the fusing belt 132 and pressure of the pressing roller 135.

Figure 6:
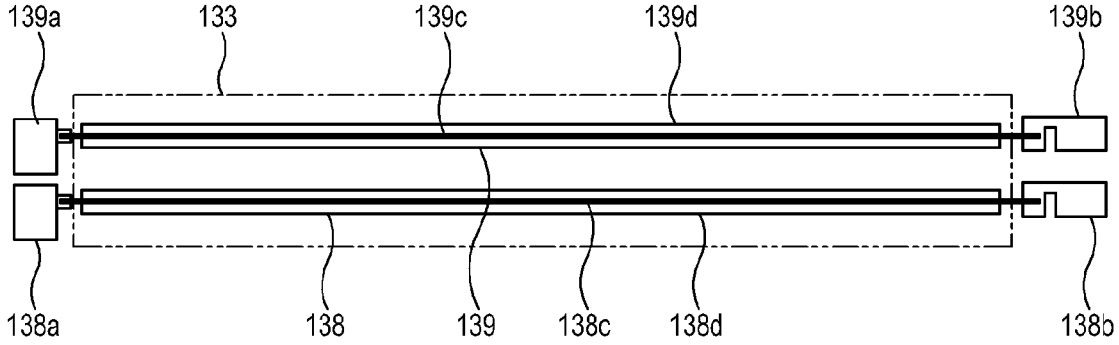
FIG. 6 is a plane view of a plurality of heat generating members of the fusing unit in FIG. 4.
Figure 7:
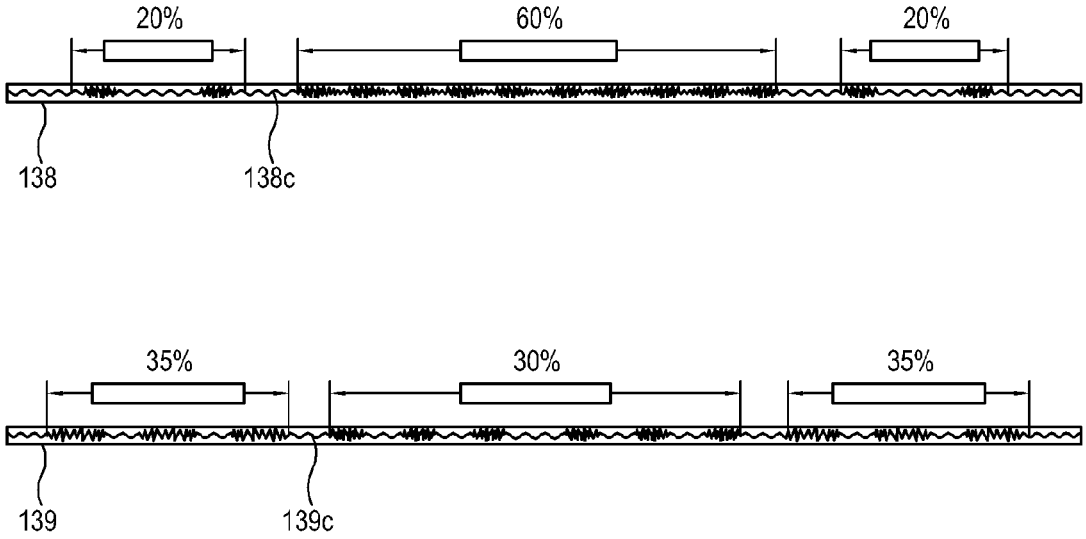
FIG. 7 is a schematic plane view for describing a heat generation amount variation of the plurality of heat generating members in FIG. 6.

As illustrated in FIGS. 6 and 7, the heat roller 133 may include the plurality of heat generating members 138 and 139. The plurality of heat generating members may include, but is not limited to, a first heat generating member 138 and a second heat generating member 139.

The first and second heat generating members 138 and 139 respectively include filaments 138*c* and 139*c*, glass tubes 138*d* and 139*d* surrounding the filaments 138*c* and 139*c*, respectively, and electrode brushes 138*a*, 138*b*, 139*a* and 139*b* respectively disposed to the opposite end parts of the filaments 138*c* and 139*c* to be supplied with an alternating current power from the power supplying unit 120.

Here, the first heat generating member 138 may be provided so that the parts on the opposite ends, in a lengthwise direction thereof, can each generate 20% of the total heat generation amount. A central part of the first heat generating member 138 can generate the other 60% of the total heat generation. For example, if the total heat generation amount of the first heat generating member 138 is 700 watt, the first heat generating member 138 may be provided so that the opposite end parts can respectively generate heat of 140 watt each, and the central part can generate heat of 420 watt. This may be implemented by varying a resistance value of the filament 138*c* of the first heat generating member 138 along the lengthwise direction to correspond to the heat generation amount. More specifically, if the resistance value of the central part of the filament 138*c* is three times as large as the resistance value of the opposite end parts thereof, the heat generation amount of the central part becomes three times as large as the resistance value of the opposite end parts when the alternating current power is supplied to the filament 138*c*. This example provides a first heat generating member 138 having the above heat generation amount distribution.

Here, the first heat generating member 138 and the second heat generating member 139 may be provided as a halogen lamp. More specifically, the first and second heat generating members 138 and 139 may have the respective filaments 138*c* and 139*c* arranged inside the respective glass tubes 138*d* and 139*d*. In addition, a plurality of filaments arranged in parallel in a single glass tube may be regarded as the plurality of heat generating members. That is, the plurality of heat generating members represents two or more members capable of independently generating heat irrespective of the shape thereof.

The pressing roller 135 is elastically biased toward a guide member 136 by an elastic member (not illustrated). If the elastic member is disposed on the opposite ends of the pressing roller 135 and elastically biases the pressing roller 135, a pressing force in a central part of the pressing roller 135 is smaller than the pressing force on the opposite ends thereof. Accordingly, fusion of a developer on a part of a printing medium, corresponding to the central part, may be deteriorated. However, by designing the heat generating members to have large heat generation amounts in their central parts that receive low pressing forces, as in the first heat generating member 138, the deterioration of the fusion of the developer in the central part may be prevented or minimized.

Figure 5:
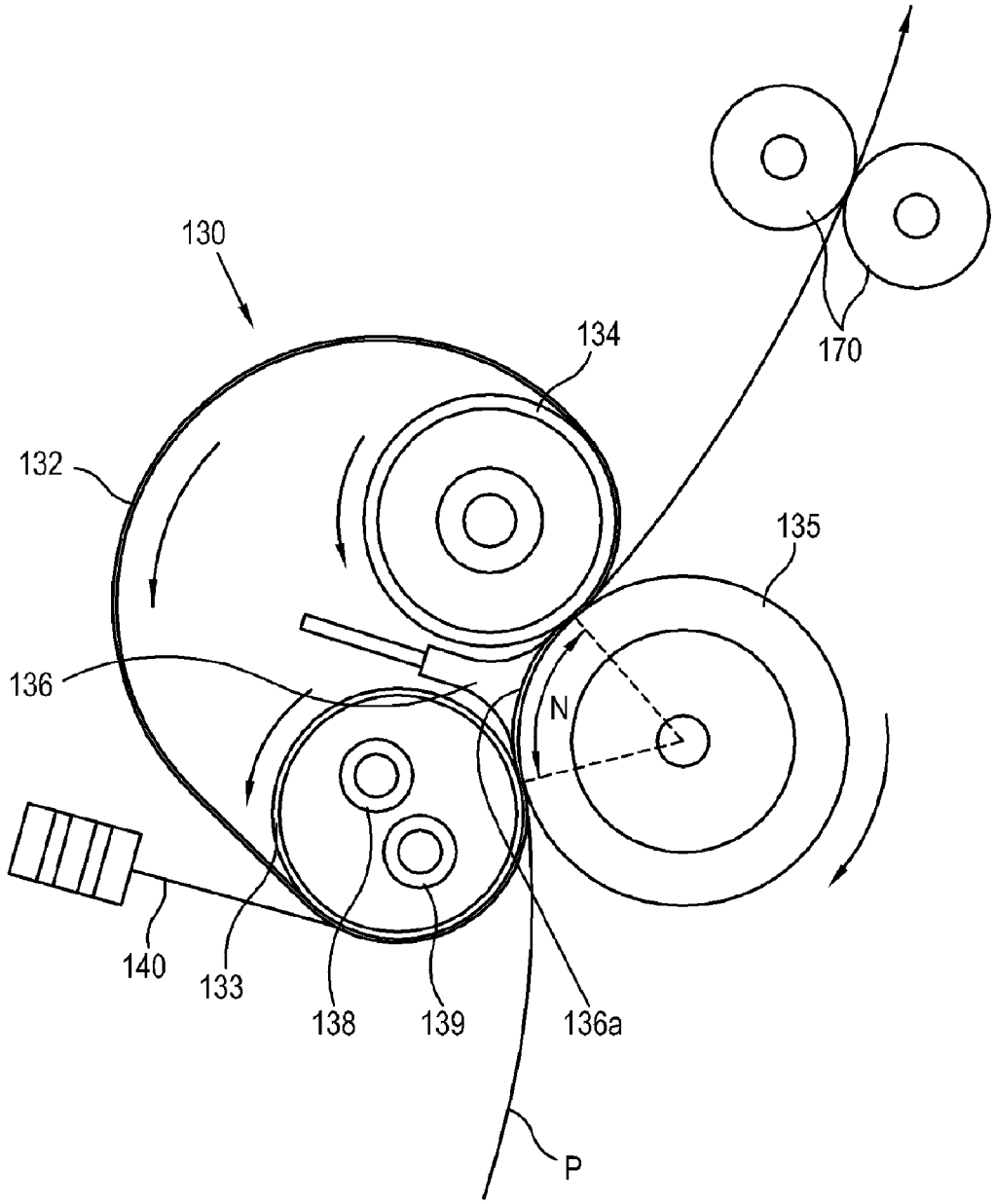
FIG. 5 is a main portion sectional view of the fusing unit in FIG. 4.

As illustrated in FIGS. 4 and 5, the fusing unit 130 may further include a guide roller 134 and the guide member 136 disposed inside the fusing belt 132.

The guide roller 134 is disposed in parallel with the heating roller 133 to guide rotation of the fusing belt 132, and is driven by a driving motor (not illustrated) to rotate the fusing belt 132.

The guide member 136 is disposed between the heating roller 133 and the guide roller 134, and enables a surface 136*a* facing the pressing roller 135 to be provided as a surface circumference corresponding to an outer surface of the pressing roller 135 so that a fine fusing nip N can be formed.

The power supplying unit 120 converts an external common alternating current power into an alternating current power supplied to the plurality of heat generating members 138 and 139 of the fusing unit 130. The converted alternating current power is controlled by the control unit 150 to be supplied to the plurality of heat generating members 138 and 139.

The control unit 150 determines which mode the image forming apparatus 100 currently corresponds to, and controls the power supplying unit 120 depending on the determined mode.

More specifically, if a present mode is a standby mode, the control unit 150 controls the power supplying unit 120 to control the alternating current power according to a waveform number control so that the plurality of heat generating members 138 and 139 can be prevented from being concurrently turned on, and to supply the controlled alternating current power to the plurality of heat generating members 138 and 139.

Here, in the standby mode, the pressing roller 135, the heating roller 133, the guide roller 134 and the fusing belt 132 are in a stop state, while only the heat generating members 138 and 139 operate. If there is no printing command from the interface unit 134, the control unit 150 may enter the standby mode. A specific control to determine whether to enter the standby mode or not may be variously provided.

Figure 8:
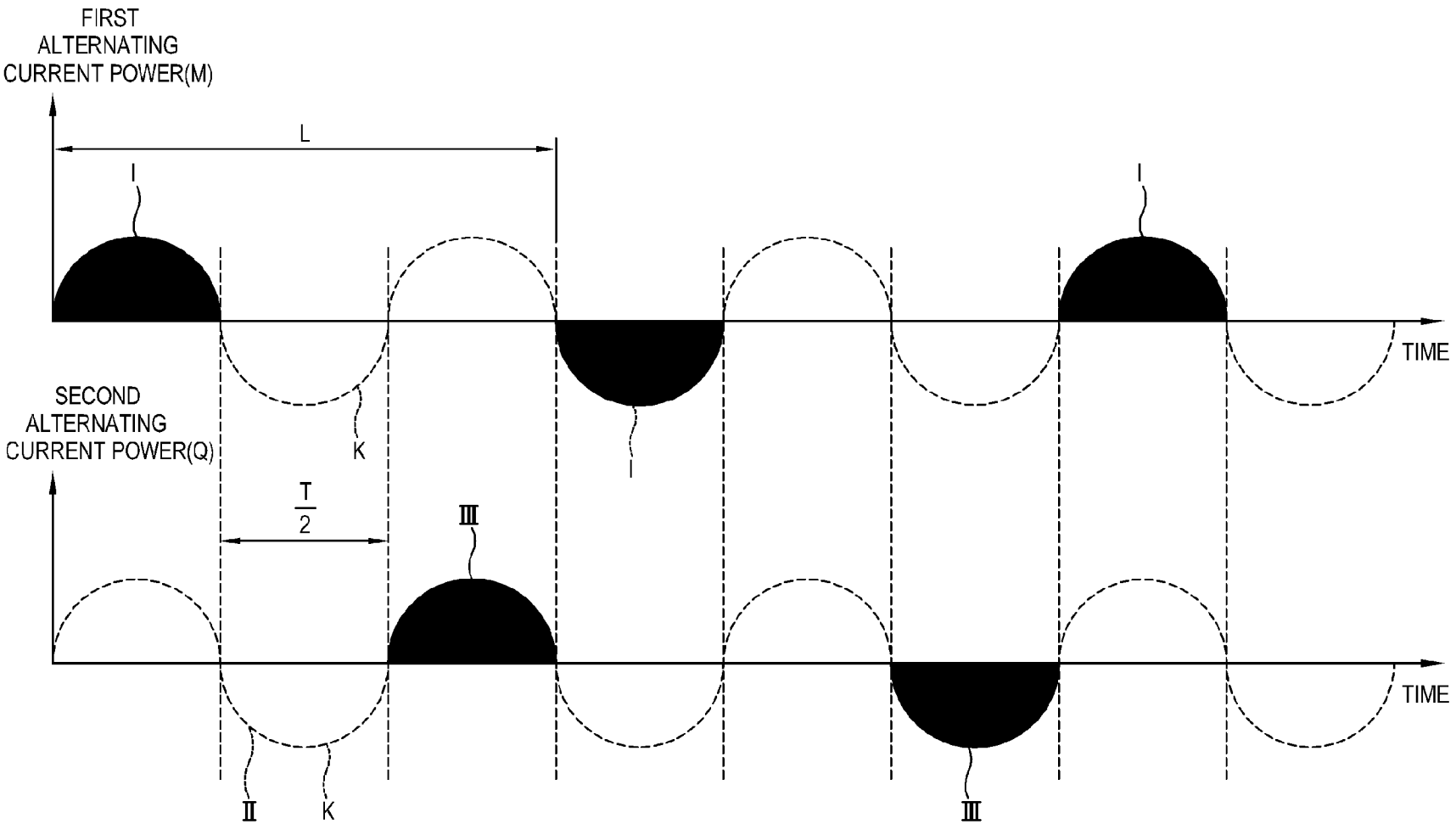
FIG. 8 illustrates a first alternating current power and a second alternating current power supplied to the plurality of heat generating members in FIG. 6 respectively.

More specifically, as illustrated in FIG. 8, the control unit 150 performs a waveform number control, where only an alternating current power that corresponds to the first half wavelength I of three half wavelength waveforms L in a waveform K of an alternating current power from the power supplying unit 120 can be supplied. This waveform number control supplies the controlled first alternating current power M to the first heat generating member 138.

Also, the control unit 150 performs a waveform number control, where only an alternating current power corresponding to the last, that is, the third half wavelength III of the three half wavelength waveforms L in the waveform K of the alternating current power from the power supplying unit 120 can be supplied. This waveform number control supplies the controlled second alternating current power Q to the second heat generating member 139.

Accordingly, the first alternating current power M and the second alternating current power Q are prevented from being supplied to the first and second heat generating members 138 and 139 at the same time, thereby reducing an inrush current. Also, since the inrush current is reduced, a malfunction and a damage possibility of a device may be reduced, as well as a flicker phenomenon.

Here, there exists a time interval by a half of a period T of the alternating current power K, that is a half period T/2 between the first alternating current power M and the second alternating current power Q. This means that the first and second heat generating members 138 and 139 are converted from an "off" state to an "on" state during a time interval by the half period, and has an effect further reducing the inrush current. Here, when the heat generating members 138 and 139 are in an on state, this means that the alternating current power is supplied to the heat generating members 138 and 139. Additionally, when the heat generating members 138 and 139 are in an off state, this means that the alternating current power is not supplied, or blocked, to the heat generating members 138 and 139.

For example, only the first heat generating member 138 is in an on state for the first half wave length I. Both the first and second heat generating members 138 and 139, respectively, are in an off state for the second half wavelength II. Additionally, only the second heat generating member 139 is in an on state for the third half wavelength III.

Alternatively, there may be no time interval between the first alternating current power M and the second alternating current power Q. For example, if a waveform number control is performed where only an alternating current power corresponding to the second half wavelength II among the three half wavelength waveforms L is supplied, there may be no time interval between the first alternating current power M and the second alternating current power Q.

Figure 9:
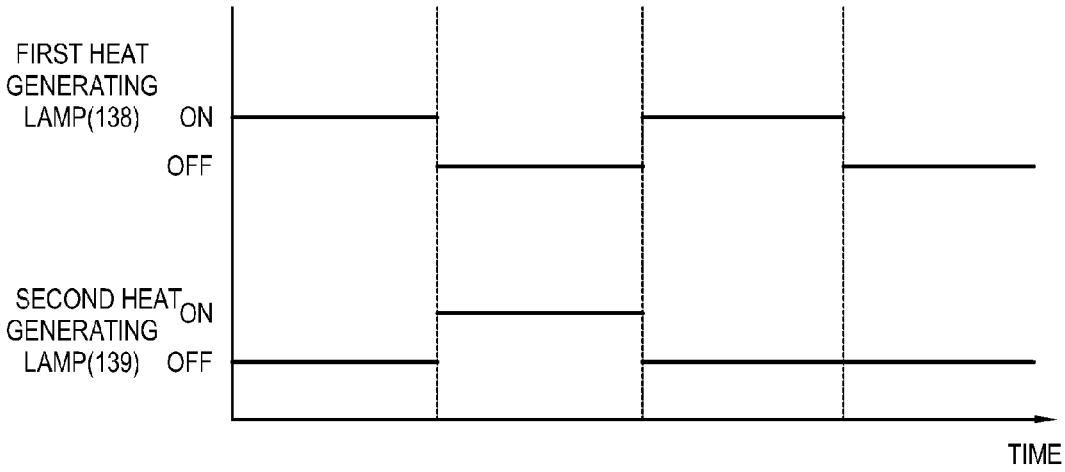
FIG. 9 is an on/off timing diagram of the plurality of heat generating members in a standby mode of the image forming apparatus in FIG. 3.

Here, the first and second heat generating members 138 and 139 may be controlled to be in an on or off state with a timing as illustrated in FIG. 9 in the standby mode. More specifically, if one of the first heat generating member 138 and the second heat generating member 139 is in an on state, the other is in an off state. Also, if one is in an off state, the other is in an on or off state. That is, the first and second heat generating members 138 and 139 are controlled so as not to be simultaneously in an on state. However, the first and second heat generating members 138 and 139 may be simultaneously in an off state. This example has the effect of further reducing the inrush current.

In the above, it is described that the 33% waveform number control is performed to control the first and second heat generating members 138 and 139 not to be simultaneously turned on in the standby mode. As another example for controlling the first and second heat generating members 138 and 139 so as not to be simultaneously in an on state, the control unit 150 may control power for one of the first and second heat generating members 138 and 139 (the first controlled heat generating member) and supply the power thereto at first, and then may perform a power control for the other (the second controlled heat generating member) and supply the power thereto after completing supplying the power the first controlled heat generating member.

More specifically, as illustrated in FIG. 7, the first heat generating member 138 is controlled according to the temperature of a central portion of the fusing unit 130 because the amount of heat generated on the central part is greater than that of the ends of the first heat generating member 138, and the second heat generating member 139 may be controlled according to the temperature of an end portion of the fusing unit 130, because the amount of heat generated on the ends is greater than that of a central part of the second heat generating unit 139.

If a sensed temperature of the central portion of the fusing unit 130 is lower than a determined temperature, the waveform number control is performed to supply an electric power to the first heat generating member 138. When this occurs, a percent (%) of a waveform number may be controlled to vary depending on the proximity of the sensed temperature of the central portion to the determined temperature. For example, if the determined temperature is 180 degree, and if a currently sensed temperature is 174 degree, the first heat generating member 138 may be controlled to be supplied with the electric power by an 80% waveform number control, and if a currently sensed temperature is 178 degree, the first heat generating member 138 may be controlled to be supplied with the electric power by a 50% waveform number control. Also, if the sensed temperature is equal to or higher than 180 degree which is the determined temperature, the power supplying is suspended.

On the other hand, if a sensed temperature of the end portion of the fusing unit 130 is lower than the determined temperature, an electric power is supplied to the second heat generating member 139 by the waveform number control.

If the temperatures of the central portion and the end portion of the fusing unit 130 are all lower than the determined temperature, the temperature of one of the first and second heat generating members 138 and 139 is increased up to the determined temperature preferentially, and power supplied thereto is suspended if the temperature increases to be equal to or higher than the determined temperature. Then, the temperature of the other heat generating member is increased up to the determined temperature. Accordingly, after the first heat generating member 138 is in an on state during a specific time, the second heat generating member 139 may be in an on state during a specific time again.

Based on this example, the waveform number control may be performed without simultaneously having both the first and second heat generating members 138 and 139 being in an on state in the standby mode.

Accordingly, by not using a phase control in the standby mode, noises due to resonance may be prevented, and concurrently, by having only one of a plurality of heat generating members in an on state, an inrush current may be reduced, thereby preventing a malfunction of a device.

As described above, the first and second heat generating members 138 and 139 are described to be controlled so as not to be simultaneously in an on state. However, although the first and second heat generating members 138 and 139 are controlled so as not to be simultaneously in an on state by a control algorithm, there may be a period of time during which the first and second heat generating members 138 and 139 are simultaneously in an on state due to a time delay, a nonlinear cause of a system, and the like. That is, periods of time during which the first and second heat generating members 138 and 139 are both in an on state may overlap.

The image forming apparatus 100 according to the present general inventive concept may further include a temperature sensing unit 140 to sense the temperature of the fusing unit 130.

As illustrated in FIG. 5, the temperature sensing unit 140 contacts a surface of the fusing belt 132 to sense the temperature of the fusing belt 132. Here, the temperature sensing unit 140 is described to sense the temperature of the fusing belt 132, but may be provided to sense each temperature of each of the plurality of heat generating members 138 and 139, or a surface temperature of the heating roller 133 as necessary. In this case, the temperature of the fusing belt 132 may be indirectly presumed.

The temperature sensing unit 140 may be provided to sense a central portion and an end portion of the fusing belt 132 of the fusing unit 130.

If the present mode is the standby mode, the control unit 150 may control the power supplying unit 120 to supply an alternating current power, controlled by the waveform number control, to the plurality of heat generating members 138 and 139, so that a temperature sensed by the temperature sensing unit 140 can correspond to a predetermined standby temperature. In this case, as described above, the power supplying unit 120 is controlled so that the plurality of heat generating members 138 and 139 can not be simultaneously in an on state. That is, while the waveform number control for the alternating current power is performed so as not to simultaneously have the plurality of heat generating members 138 and 139 in an on state, the power supplying unit 120 is controlled to maintain the temperature of the fusing belt 132 at the standby temperature.

If the present mode is a warming up mode, the control unit 150 controls the power supplying unit 120 to control the alternating current power depending on at least one of the phase control and the waveform number control.

Here, the warming up mode may be performed if the image forming apparatus 100 is initially supplied with an electric power, restored from an error state such as a jam, a cover open, etc., or returned from a power saving mode. In the warming up mode, the pressing roller 135, the heating roller 133, the guide roller 134 and the fusing belt 132 are driven, and the temperature of the fusing belt 132 increases to a fusing objective temperature.

For example, the power saving mode may be performed if there is no printing command during a predetermined time in the standby mode. The power saving mode is a mode for minimizing power consumption. In the power saving mode, the fusing unit 130 is not driven, and the heat generating members 138 and 139 are not supplied with an electric power source and are therefore not in an on state.

As the image forming apparatus 100 is initially supplied with an electric power, for example, a mode conversion of the image forming apparatus 100 may be: the warming up mode→the standby mode→a printing mode→the standby mode→the power saving mode→the warming up mode→the standby mode, etc. in order.

If the present mode is the printing mode, the control unit 150 controls the power supplying unit 120 to control the alternating current power depending on the phase control and the waveform number control.

Here, the printing mode includes a printing process in which printing is performed on a printing medium. The printing process starts from picking up the printing medium, and then, an image is fused on the printing medium as the picked up printing medium passes through the image forming unit 110 and the fusing unit 130. Then, the printing process is ended as the printing medium fused with the image is discharged to the outside by a discharging roller 170 in FIG. 5.

Also, the starting of the printing process and the ending of the printing process in the printing mode may be differently determined. For example, the time in which the light scanning unit (LSU) operates may be regarded as the starting of the printing process, and the time in which a driving unit driving each roller 170, 132, 133 and 135 in FIG. 5 is suspended may be regarded as the ending of the printing process.

Figure 10:
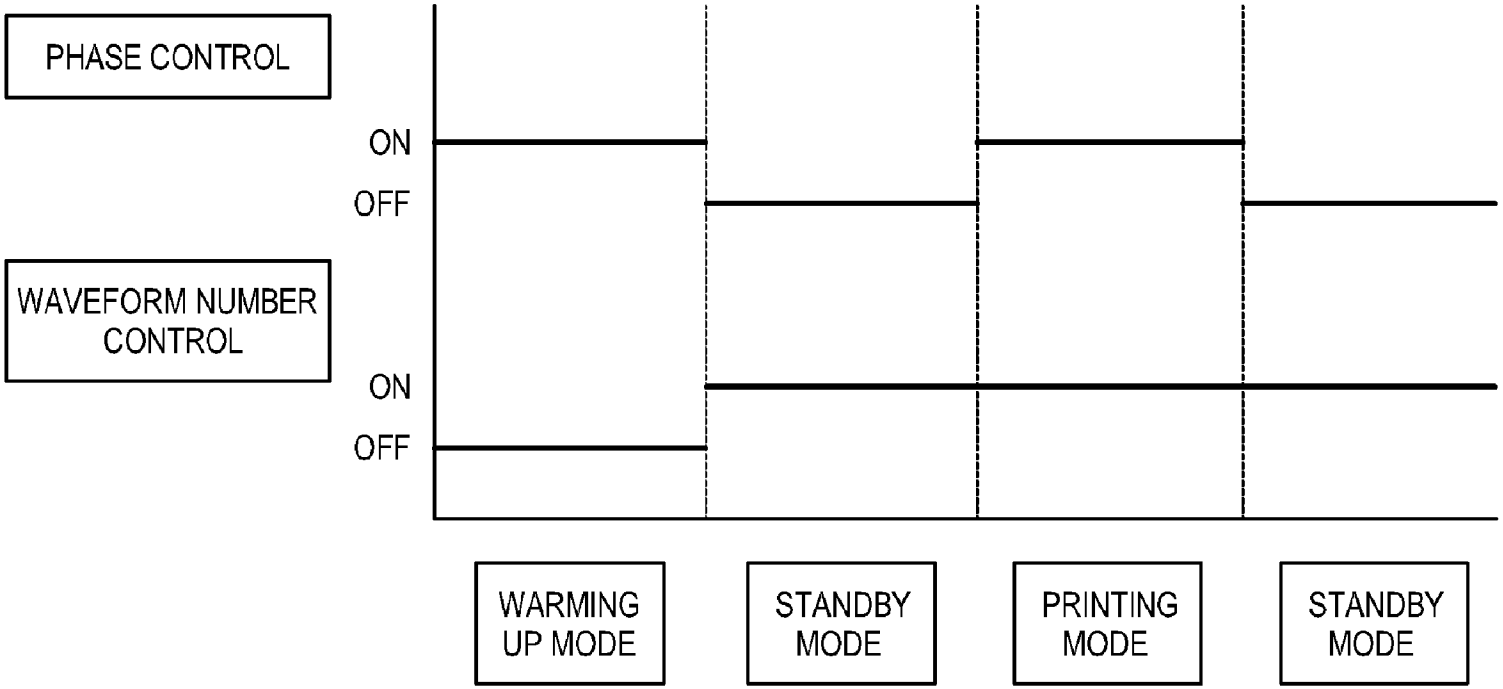
FIG. 10 illustrates a phase control and a waveform number control depending on a mode of the image forming apparatus in FIG. 3.

FIG. 10 illustrates how an alternating current power to be supplied to the heat generating members 138 and 139 is controlled by the phase control and the waveform number control.

As necessary, a control type (phase control or waveform number control) of the electric power, depending on each mode may be displayed in a display unit (not illustrated) of the image forming apparatus 100. If the phase control and the waveform number control are applied together, like as in the printing mode, a power control type currently performed may be displayed in the display unit according to elapse of time. Here, the display unit may include a liquid crystal display (LCD) panel.

As illustrated in FIG. 3, the control unit 150 may include a waveform number control unit 153 controlling an alternating current power supplied to the fusing unit 130 by a waveform number control, and a phase control unit 155 controlling the alternating current power by a phase control.

The control unit 150 may determine which of the standby mode, the warming up mode and the printing mode the present mode corresponds to, and therefore control at least one of the waveform number control unit 153 and the phase control unit 155 to operate depending on each mode.

More specifically, as illustrated in FIG. 10, the control unit 150 respectively turns the phase control unit 155 on, and the waveform number control unit 153 off in the warming up mode. Also, the control unit 150 turns the phase control unit 155 off, and the waveform number control unit 153 on, in the standby mode as described above. Also, the control unit 150 simultaneously turns the phase control unit 155 and the waveform number control unit 153 on in the printing mode. That is, in the printing mode, the alternating current power to be supplied to the fusing unit 130 (precisely, the heat generating members 138 and 139) is controlled by the phase control and the waveform number control.

Here, in the warming up mode, the waveform number control unit 153 is described to be turned off, but may be turned on as necessary. The phase control unit 155 and the waveform number control unit 153 may both be turned on as necessary.

In the warming up mode and the printing mode, the plurality of heat generating members 138 and 139 may be controlled so as not to be simultaneously in an on state as necessary.

Hereinafter, a control type of an alternating current power to be supplied to the plurality of heat generating members 138 and 139 in the printing mode will be described by referring to FIG. 11.

For example, in the printing mode, the power supplying unit 150 is controlled so that a temperature sensed by the temperature sensing unit 140 can be within a predetermined range with respect to a predetermined fusing objective temperature. Here, a lower boundary value with respect to the fusing objective temperature will be referred to as a lower fusing temperature limit, and an upper boundary value will be referred to as an upper fusing temperature limit.

Figure 11:
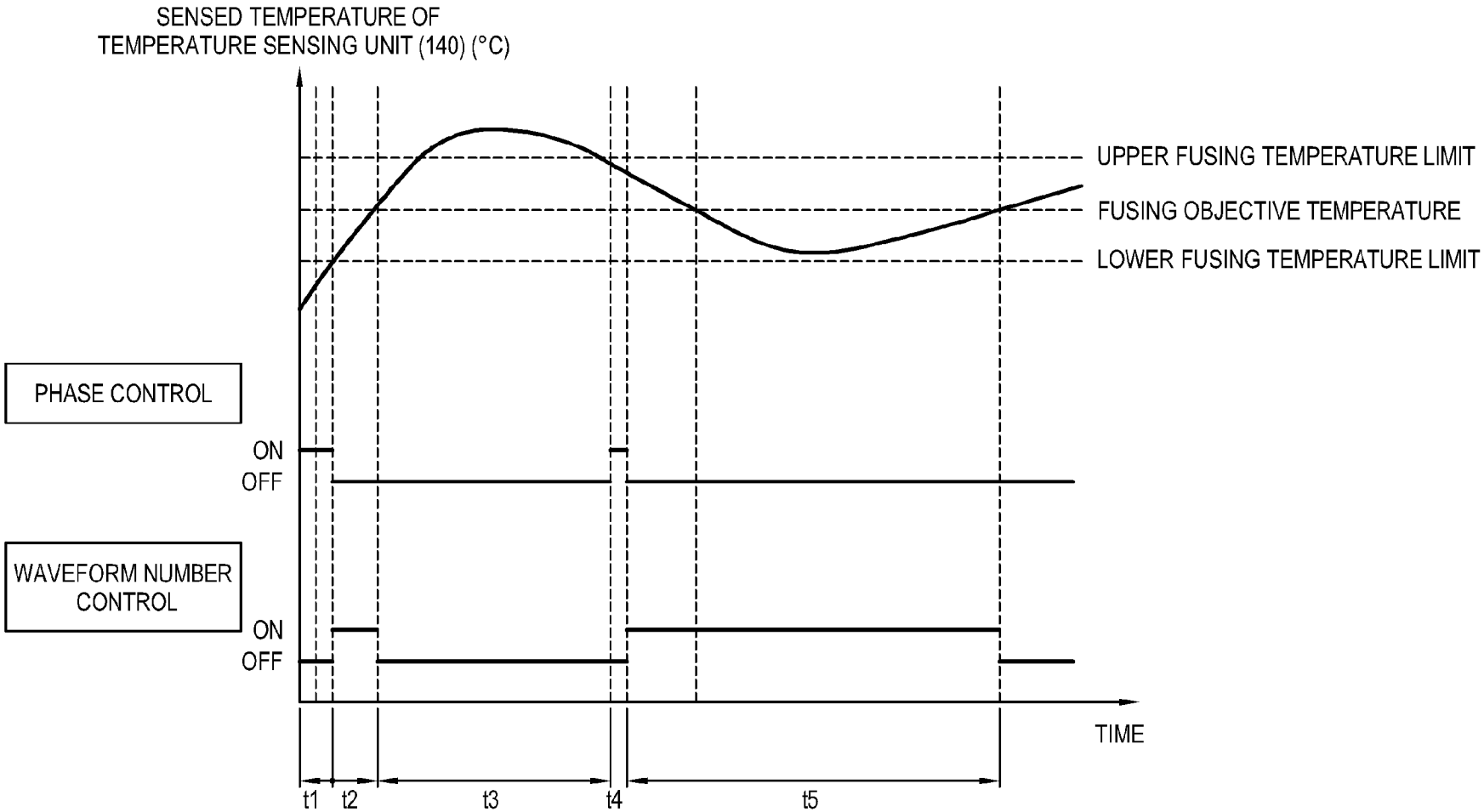
FIG. 11 is a control timing diagram of the fusing unit in a printing mode of the image forming apparatus in FIG. 3.

As illustrated in FIG. 11, if a temperature sensed by the temperature sensing unit 140 is equal to or lower than the lower fusing temperature limit, that is, during a time t1, the phase control is performed.

If the sensed temperature is equal to or higher than the lower fusing temperature limit, the waveform number control is performed during a predetermined time t2.

The phase control and the waveform number control are all turned off during a predetermined time t3 after the predetermined time t2 elapses. That is, the alternating current power is not supplied to the heat generating members 138 and 139 of the fusing unit 130 during the predetermined time t3.

After the predetermined time t3 elapses, the phase control is performed during a time t4, and the waveform number control is performed during a time t5.

Here, if the sensed temperature exceeds the fusing objective temperature while performing the waveform number control, the waveform number control is turned off. That is, the waveform number control and the phase control are all turned off.

As illustrated in FIG. 11, an inrush current may be reduced by performing the phase control in advance before performing the waveform number control. In this case, to reduce the inrush current, the alternating current power may be controlled by the phase control to minutely chop the phase of the half wavelength alternating current power. For example, the phase of the half wavelength alternating current may be chopped in a chopping section of less than or equal to 33% illustrated in FIG. 1.

Here, FIG. 11 illustrates this example, where the fusing unit 130 may be controlled in the printing mode by using the waveform number control and the phase control.

A belt type using the fusing belt 132 of the fusing unit 130 is described above. Alternatively, a roller type, in which the heating roller 133 and the pressing roller 135 directly contact each other, may be provided. In this case, the guide member 136 and the guide roller 134 may be omitted.

Figure 12:
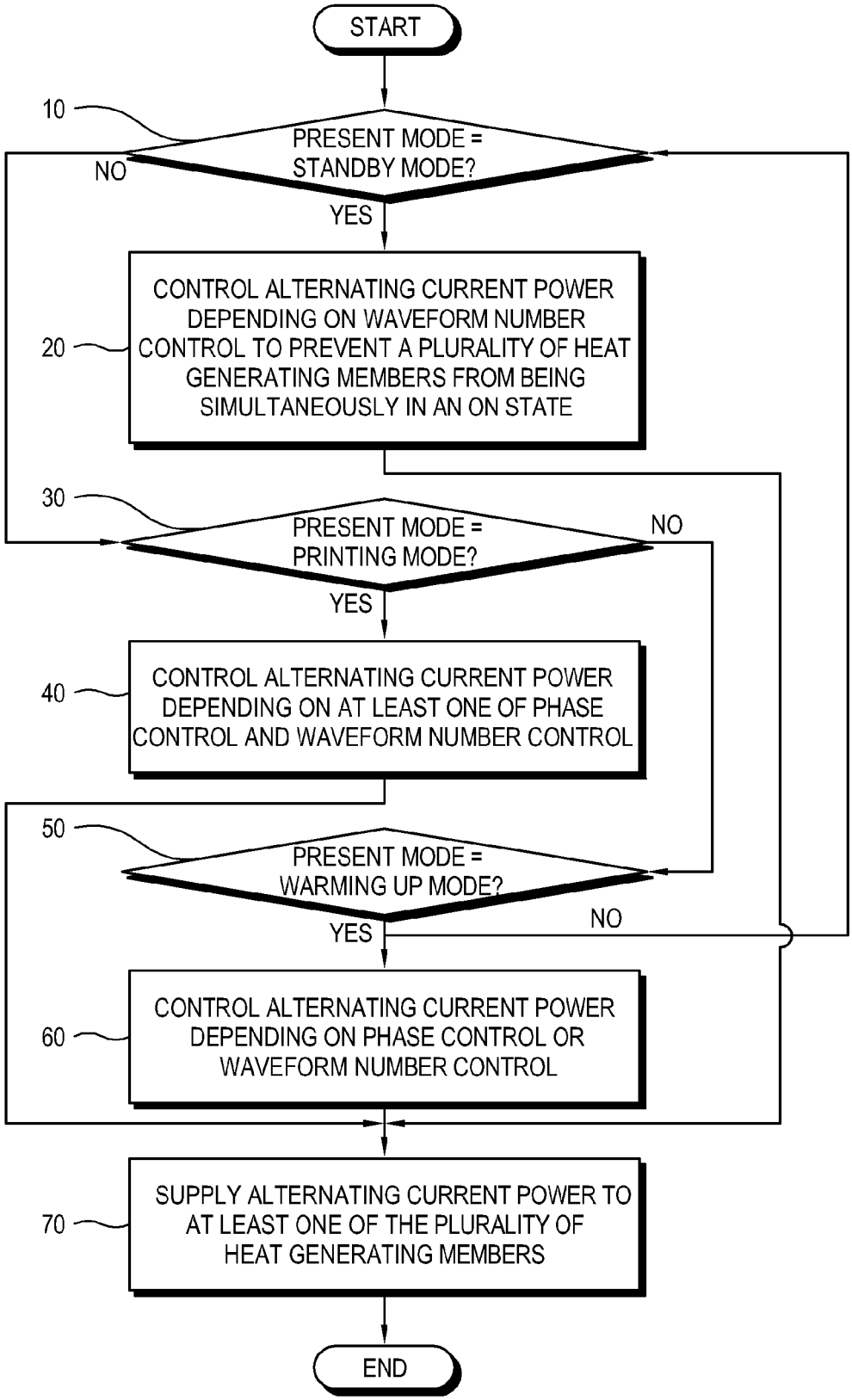
FIG. 12 is a flowchart of a fusing unit method of controlling an image forming apparatus according to an exemplary embodiment of the present general inventive concept.

Hereinafter, method of controlling a fusing unit of an image forming apparatus according to an exemplary embodiment of the present general inventive concept will be described by referring to FIGS. 3 and 12.

It is determined whether a present mode of an image forming apparatus 100 is a standby mode or not (S10). Here, determining the present mode of the image forming apparatus may be further included before the operation S10.

If the present mode is the standby mode (YES of S10), an alternating current power is controlled depending on a waveform number control so that a plurality of heat generating members of a fusing unit 130 can be prevented from being simultaneously in an on state (S20).

If the present mode is not the standby mode (NO of S10), it is determined whether the present mode is a printing mode or not (S30). If the present mode is the printing mode (YES of S30), the alternating current power is controlled depending on at least one of the phase control and the waveform number control (S40).

If the present mode is not the printing mode (NO of S30), it is determined whether the present mode is a warming up mode or not (S50). If the present mode corresponds to the warming up mode (YES of S50), the alternating current power is controlled depending on the phase control or the waveform number control (S60). As necessary, if the present mode is the warming up mode, the alternating current power may be controlled by simultaneously using the phase control and the waveform number control, as used in the printing mode.

If the present mode is not the warming up mode (NO of S50), the above operations S10 to 40 are repeated again.

After the present mode corresponds to one of the printing mode and the warming up mode and the alternating current power is controlled depending thereon, the alternating current power is supplied to at least one of the plurality of heat generating members (S70).

As described above, an image forming apparatus and a method of controlling a fusing unit of the image forming apparatus according to the present general inventive concept have the following effects.

First, an inrush current is reduced, thereby reducing a flicker phenomenon.

Second, noises due to a resonance phenomenon in a phase control may be reduced. Especially, since the noises may sound relatively loud to a user when the fusing unit does not rotate as if in a standby mode, the noises may be prevented from being caused in the standby mode.

Third, a waveform number control and a phase control are appropriately used depending on a present mode of the image forming apparatus, thereby improving a fusing efficiency.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A method of controlling a fusing unit of an image forming apparatus, the method comprising:

detecting a present mode of the image forming apparatus;

selecting a waveform number control to control an electric power which is supplied to the fusing unit when the present mode is a standby mode; and supplying the electric power to one of a plurality of heat generating members depending on the waveform number control to prevent the plurality of heat generating members from being simultaneously supplied with electric power.

2. The method according to claim 1, further comprising:

controlling the electric power depending on at least one of a phase control and the waveform number control when the present mode is a printing mode.

3. The method according to claim 2, wherein the controlling of the electric power comprises:

controlling the electric power depending on the phase control when a temperature of the fusing unit is lower than or equal to a predetermined value, and controlling the electric power depending on the waveform number control after performing the phase control.

4. The method according to claim 1, further comprising:

controlling the electric power depending on a phase control or the waveform number control when the present mode is a warming up mode.

5. The method according to claim 1, wherein the controlling of the electric power comprises converting the plurality of heat generating members from an off state to an on state one after another during a time interval.

6. The method according to claim 1, wherein, a waveform number control is ended for the electric power to be supplied to the one of the heat generating members, and a waveform number control is started for the electric power to be supplied to the remaining heat generating member.

7. The method according to claim 1, wherein the selecting of the waveform number control comprises selecting the waveform number control of a different percent (%), based on a sensed temperature of the fusing unit.

8. The method according to claim 1, further comprising:

controlling the electric power based on a temperature of a central portion of the fusing unit for one of the plurality of heat generating members, and a temperature of an end portion of the fusing unit for another thereof.

9. The method according to claim 1, further comprising displaying, in a display unit, a control type of the electric power depending on the mode of the image forming apparatus.

10. An image forming apparatus, comprising:

a fusing unit which comprises a plurality of heat generating members to fuse a developer on a printing medium;

a power supplying unit which supplies an electric power to the fusing unit; and a control unit which controls the power supplying unit to control the electric power for the fusing unit depending on a waveform number control, and to apply the electric power to one of the heat generating members to prevent the electric power from being simultaneously supplied to the plurality of heat generating members when a present mode is a standby mode.

11. The image forming apparatus according to claim 10, wherein the control unit controls the electric power depending on at least one of a phase control and the waveform number control when the present mode is a printing mode.

12. The image forming apparatus according to claim 11, wherein the control unit controls the electric power depending on the phase control when a temperature of the fusing unit is lower than or equal to a predetermined value, and then controls the electric power depending on the waveform number control.

13. The image forming apparatus according to claim 10, wherein the control unit controls the electric power depending on a phase control or the waveform number control when the present mode is a warming up mode.

14. The image forming apparatus according to claim 10, wherein the plurality of heat generating members are converted from an off state to an on state one after another during a time interval.

15. The image forming apparatus according to claim 10, wherein the control unit starts a waveform number control for the electric power to be supplied to the remaining heat generating member when a waveform number control is ended for the electric power to be supplied to the one of the heat generating members.

16. The image forming apparatus according to claim 10, wherein the control unit controls the electric power by applying the waveform number control of a different percent (%), based on a sensed temperature of the fusing unit.

17. The image forming apparatus according to claim 10, wherein the control unit controls the electric power based on a temperature of a central portion of the fusing unit for one of the plurality of heat generating members, and a temperature of an end portion of the fusing unit for another thereof.

18. The image forming apparatus according to claim 10, further comprising:

a display unit, wherein the display unit displays a control type of the electric power depending on the mode of the image forming apparatus.

19. An image forming apparatus, comprising:

a fusing unit which comprises a plurality of heat generating members to fuse a developer on a printing medium;

a power supplying unit to supply an electric power to the plurality of heat generating members; and a control unit to control the electric power which is to be supplied to the plurality of heat generating members depending on a plurality of modes of the image forming apparatus, and to prevent the electric power from being simultaneously supplied to the plurality of heat generating members when a present mode of the image forming apparatus is a standby mode.

20. A method of controlling a fusing unit of an image forming apparatus, the method comprising:

detecting a present mode of the image forming apparatus as a standby mode;

selecting a waveform number control based on the standby mode;

controlling an electric power based on the selected waveform number control; and supplying the electric power to one of a plurality of heat generating members.

21. The method according to claim 20, wherein, the waveform number control is ended for the electric power to be applied to the one of the heat generating members, and the waveform number control is started for the electric power to be applied to the remaining heat generating member.

22. The method according to claim 20, wherein the selecting of the control comprises selecting the waveform number control of a different percent (%), based on a sensed temperature of the fusing unit.

* * * * *